US009946292B2

(12) United States Patent
Wakimoto

(10) Patent No.: US 9,946,292 B2
(45) Date of Patent: Apr. 17, 2018

(54) POWER SUPPLY CIRCUIT

(71) Applicant: KABUSHIKI KAISHA TOSHIBA, Tokyo (JP)

(72) Inventor: Satoshi Wakimoto, Yokohama Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 15/445,737

(22) Filed: Feb. 28, 2017

(65) Prior Publication Data

US 2018/0074540 A1 Mar. 15, 2018

(30) Foreign Application Priority Data

Sep. 14, 2016 (JP) ..... 2016-179862

(51) Int. Cl.
*G05F 5/00* (2006.01)

(52) U.S. Cl.
CPC ..... *G05F 5/00* (2013.01)

(58) Field of Classification Search
CPC ..... G05F 5/00; G05F 1/56; H02M 3/156
USPC ..... 323/282, 285, 299, 300
See application file for complete search history.

(56) References Cited

U.S. PATENT DOCUMENTS 9,459,639 B2 10/2016 Kasai
9,762,225 B2 * 9/2017 Katsumata ..... H03K 5/24
2008/0088998 A1 * 4/2008 So ..... H02H 3/006 361/93.9
2009/0058496 A1 3/2009 Kapoor
2012/0001608 A1 * 1/2012 Sato ..... H02M 3/1588 323/282
2012/0169309 A1 * 7/2012 Zhang ..... H02M 1/32 323/271
2012/0274153 A1 * 11/2012 Maxwell ..... H02J 7/0036 307/126
2014/0062449 A1 * 3/2014 Qu ..... G05F 3/02 323/311
2014/0159496 A1 * 6/2014 Lee ..... H02J 1/10 307/80
2014/0225585 A1 * 8/2014 Buthker ..... H02M 3/156 323/285

(Continued)

FOREIGN PATENT DOCUMENTS

JP 2000089836 A 3/2000
JP 2009528748 A 8/2009
JP 2016025801 A 2/2016

*Primary Examiner* — Alex Torres-Rivera
(74) *Attorney, Agent, or Firm* — Patterson & Sheridan, LLP

(57) ABSTRACT

A power supply circuit includes a N-channel switching element having a drain connected to an input terminal and a source connected to an output terminal, and a P-channel switching element having a drain connected to the output terminal and a source connected to the input terminal. A voltage detection circuit is connected to the input terminal and configured to detect a level of an input voltage supplied at the input terminal. A voltage boosting circuit is configured to boost the input voltage and supply a boosted voltage to a gate of the N-channel switching element. A control circuit is configured to control the N-channel switching element, the P-channel switching element, and the voltage boosting circuit based on the level of the input voltage detected by the voltage detection circuit.

20 Claims, 5 Drawing Sheets

(56) References Cited

U.S. PATENT DOCUMENTS

| | | | | |
|---|---|---|---|---|
| 2014/0375291 | A1* | 12/2014 | Tomasz | H02M 3/156<br>323/282 |
| 2017/0117803 | A1* | 4/2017 | Matsuki | H02M 3/156 |

* cited by examiner

POWER SUPPLY CIRCUIT

CROSS-REFERENCE TO RELATED APPLICATION

This application is based upon and claims the benefit of priority from Japanese Patent Application No. 2016-179862, filed Sep. 14, 2016, the entire contents of which are incorporated herein by reference.

FIELD

Embodiments described herein relate generally to a power supply circuit.

BACKGROUND

A load switch integrated circuit (IC) is an example of a power supply circuit. The load switch IC includes a switching element that controls whether power is supplied to a load or not. If the switching element is an N-channel metal oxide semiconductor (MOS) transistor, then a voltage boosting circuit is also provided generally. The voltage boosting circuit boosts an input voltage and supplies the boosted voltage to the gate of the N-channel MOS transistor. In this manner, it is possible to stabilize an on-resistance of the switching element regardless of the level of the input voltage. However, as the voltage boosting circuit operates, the consumption current of the load switch IC increases.

When the switching element is a P-channel MOS transistor, a voltage boosting circuit is not required, and thus, the consumption current is reduced. However, when the P-channel MOS transistor is used, the input voltage may decrease, and thereby, a switching operation of the load switch IC tends to become unstable.

DETAILED DESCRIPTION

In general, according to one embodiment, a power supply circuit includes a N-channel switching element having a drain connected to an input terminal and a source connected to an output terminal, and a P-channel switching element having a drain connected to the output terminal and a source connected to the input terminal. A voltage detection circuit is connected to the input terminal and configured to detect a level of an input voltage supplied at the input terminal. A voltage boosting circuit is configured to boost the input voltage and supply the boosted voltage to a gate of the N-channel switching element. A control circuit is configured to control the N-channel switching element, the P-channel switching element, and the voltage boosting circuit based on the level of the input voltage detected by the voltage detection circuit.

Hereinafter, example embodiments will be described with reference to the drawings. The present disclosure is not limited the example embodiments.

First Embodiment

Figure 1:
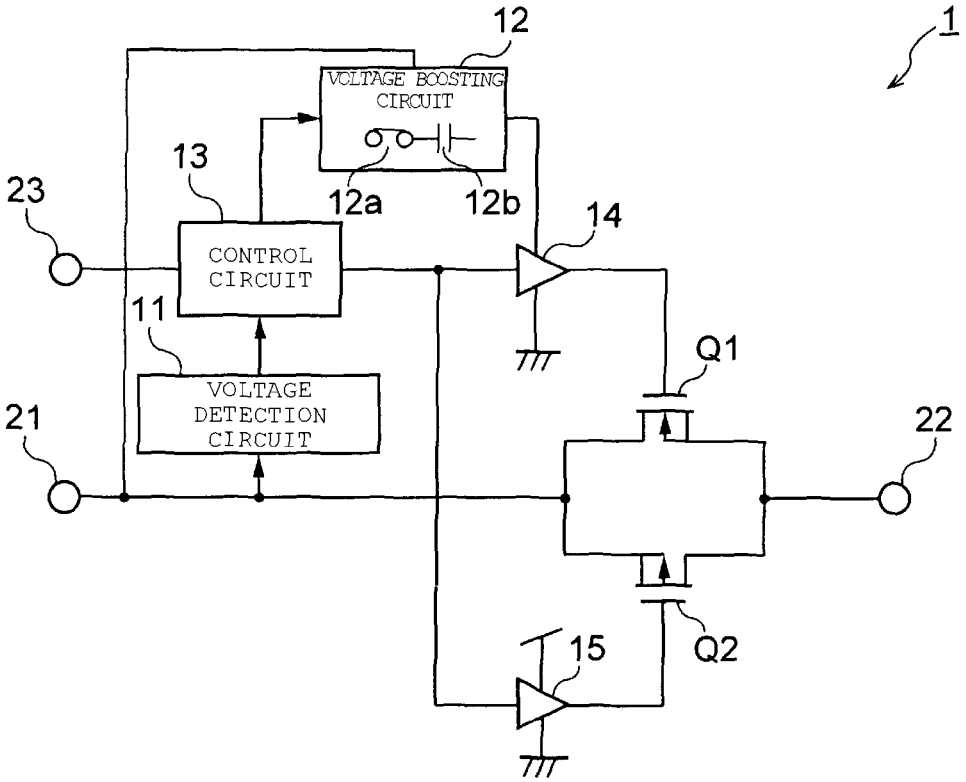
FIG. 1 is a circuit diagram illustrating a schematic configuration of a power supply circuit according to a first embodiment.

FIG. 1 is a circuit diagram illustrating a schematic configuration of a power supply circuit according to a first embodiment. Hereinafter, an example will be described in which a power supply circuit according to the first embodiment is applied to a load switch IC that controls whether or not to supply power to a load. However, the power supply circuit can also be applied to devices other than the load switch IC.

As illustrated in FIG. 1, a power supply circuit 1 according to the first embodiment includes switching elements Q1 and Q2, a voltage detection circuit 11, a voltage boosting circuit 12, a control circuit 13, an amplification circuit 14, and an amplification circuit 15. Here, the switching element Q1 corresponds to an N-channel first switching element, and the switching element Q2 corresponds to a P-channel second switching element.

The switching element Q1 comprises, for example, an N-channel metal oxide semiconductor field effect transistor (MOSFET). The switching element Q1 has a drain is connected to an input terminal 21, a source is connected to an output terminal 22, and a gate is connected to the voltage boosting circuit 12 via the amplification circuit 14.

The input terminal 21 can be connected to an external power supply to receive power from the external power supply. In addition, the output terminal 22 can be connected to the aforementioned load. For example, the load can comprise a driving circuit for a digital camera.

The switching element Q2 comprises, for example, a P-channel MOSFET. The switching element Q2 has a drain is connected to the output terminal 22, a source is connected to the input terminal 21, and a gate is connected to the control circuit 13 via the amplification circuit 15. That is, the switching element Q2 is connected in parallel to the switching element Q1 between the input terminal 21 and the output terminal 22, with gates of the switching elements (Q1 and Q2) being ultimately connected to the control circuit 13.

The voltage detection circuit 11 detects an input voltage supplied to the input terminal 21, and provides the detection results to the control circuit 13. For example, the voltage detection circuit 11 includes a comparison circuit which compares the input voltage to a predetermined reference voltage.

The voltage boosting circuit 12 boosts the input voltage (received at input terminal 21) and supplies the boosted voltage to the amplification circuit 14, based on control of the control circuit 13. For example, the voltage boosting circuit 12 includes a charge pump circuit including a switch 12*a* and a capacitor 12*b*. If the switch 12*a* is turned on based on control of the control circuit 13, the capacitor 12*b* is charged with a voltage. In order to be able to adjust a voltage boost value, the voltage boosting circuit 12 may include a plurality of the switches 12*a* and a plurality of the capacitors 12*b*.

The control circuit 13 controls switching operations of the switching element Q1 and the switching element Q2, based on a signal which is input at a control terminal 23. Thereby, the control circuit 13 controls whether or not to supply power to a load connected to the output terminal 22. At this time, the control circuit 13 controls the switching element Q1, the switching element Q2, and the voltage boosting circuit 12, based on the level of the input voltage, which is detected by the voltage detection circuit 11.

If the input voltage (as detected by the voltage detection circuit 11) is lower than or equal to the predetermined reference voltage, the control circuit 13 turns on the switch 12*a* of the voltage boosting circuit 12. By the switch 12*a* being turned on, the voltage boosting circuit 12 boosts the input voltage. The boosted input voltage is modulated by the amplification circuit 14 according to a voltage signal from the control circuit, and thereafter, the amplified control signal is supplied to the gate of the switching element Q1. As a result, the switching element Q1 is turned on by the gate voltage (amplified control signal) supplied from the amplification circuit 14.

At the same time the control circuit 13 turns on the switch 12*a* of the voltage boosting circuit 12 the control circuit 13 turns off the switching element Q2. At this time, a voltage signal which is output from the control circuit 13 is amplified by the amplification circuit 15 and this amplified voltage signal is input to the gate of the switching element Q2 as an off-signal. As a result, the switching element Q2 is turned off.

On the other hand, if the input voltage which is detected by the voltage detection circuit 11 is higher than the predetermined reference voltage, the control circuit 13 turns off the switch 12*a* of the voltage boosting circuit 12, which stops the voltage boosting operation of the voltage boosting circuit 12, and thus, a voltage is not applied to the gate of the switching element Q1 at a level sufficient to keep the switching element Q1 in an on-state (conductive state). As a result, the switching element Q1 is turned off.

In addition, the signal, which is output from the control circuit 13 and amplified by the amplification circuit 15, and is input to the gate of the switching element Q2 as an on-signal. As a result, the switching element Q2 is turned on.

Figure 2:
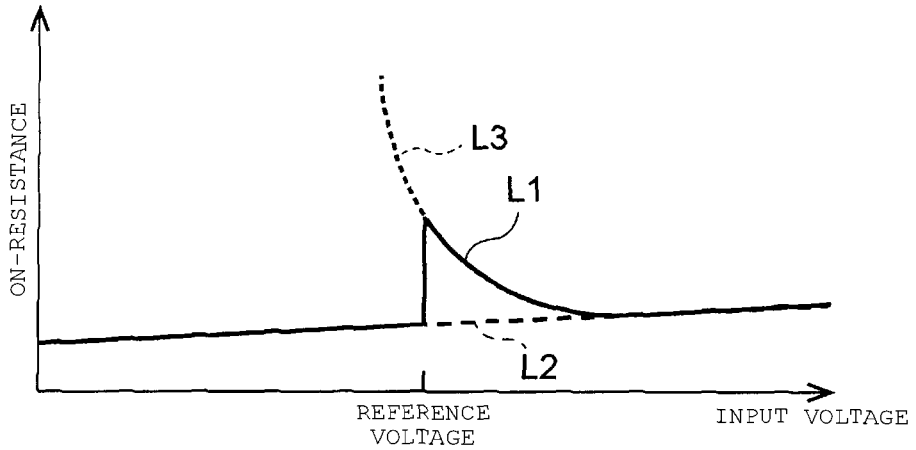
FIG. 2 is a graph illustrating a relationship between an input voltage and an on-resistance of a switching element.
Figure 3:
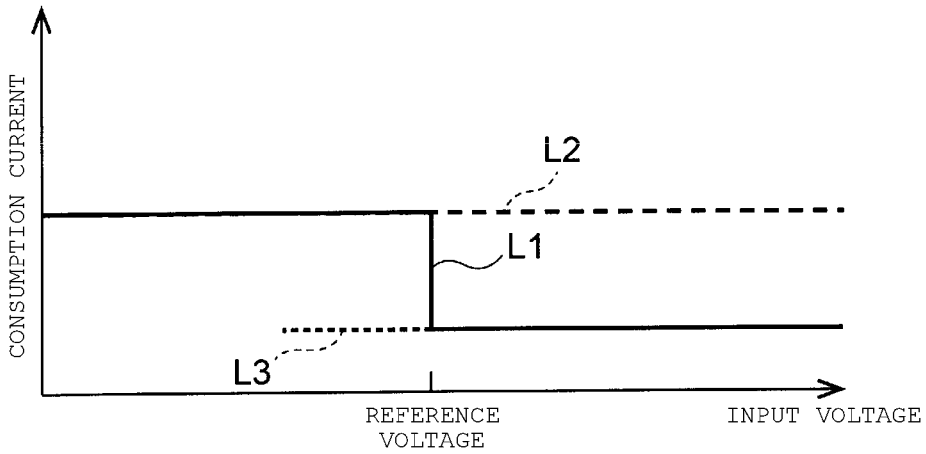
FIG. 3 is a graph illustrating a relationship between the input voltage and a consumption current of the power supply circuit.

FIG. 2 is a graph illustrating a relationship between the input voltage and on-resistance of the switching elements Q1 and Q2. FIG. 3 is a graph illustrating a relationship between the input voltage and a consumption current of the power supply circuit 1. In FIG. 2 and FIG. 3, a solid line L1 denotes characteristics when the switching element Q1 and the switching element Q2 are considered together. A dashed line L2 denotes characteristics when the switching element Q1 and the voltage boosting circuit 12 are considered together. A dashed line L3 denotes characteristics when the switching element Q2 is considered independently.

When the input voltage is higher than the reference voltage, the switching element Q1 is turned off as described above and the switching element Q2 is turned on. When switching element Q2 is on its on-resistance is relatively small in the region in which the input voltage is higher than the reference voltage, as illustrated in FIG. 2. In addition, the voltage boosting circuit 12 is in a deactivated state in this region. Accordingly, the consumption current of the power supply circuit 1 is reduced, as illustrated in FIG. 3.

On the other hand, if the switching element Q2 is turned on and the input voltage decreases below the reference voltage, the on-resistance of the switching element Q2 increases rapidly, as denoted by the dashed line L3 of FIG. 2. As the input voltage decreases, the gate-source voltage of the switching element Q2 decreases. This causes the switching operation of the switching element Q2 to be easily destabilized.

Here, as described above, in the power supply circuit 1 according to the first embodiment, if the input voltage is lower than or equal to the reference voltage, the control circuit 13 turns off the switching element Q2 and activates the voltage boosting circuit 12 (turning on the switching element Q1). Accordingly, the gate-source voltage of the switching element Q1 becomes constant regardless of a level of the input voltage due to the operation of the voltage boosting circuit 12. This causes the switching operation of the switching element Q1 to be stabilized.

In summary, according to the first embodiment described above, the N-channel switching element Q1 is driven by operation of the voltage boosting circuit 12 when the input voltage is lower than the reference voltage. Thus, it is possible to ensure a stable operation even as the input voltage varies. In addition, the P-channel switching element Q2 is driven only when the input voltage is higher than the reference voltage. Thus, it is possible to reduce consumption current.

Second Embodiment

Figure 4:
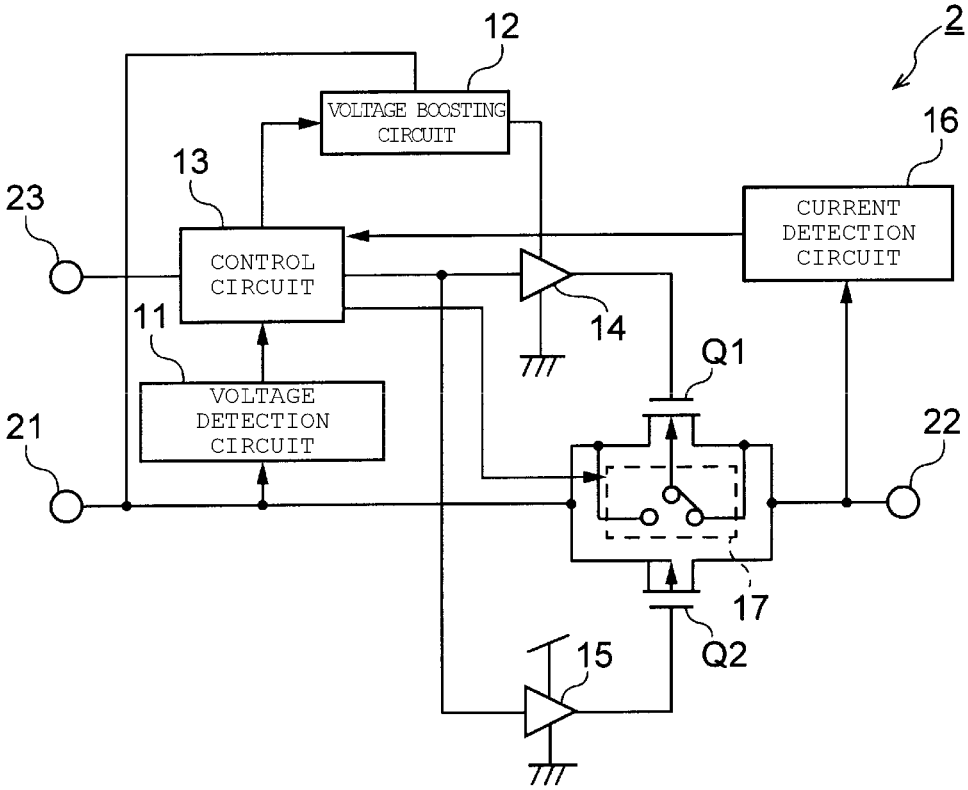
FIG. 4 is a circuit diagram illustrating a schematic configuration of a power supply circuit according to a second embodiment.

FIG. 4 is a circuit diagram illustrating a schematic configuration of a power supply circuit according to a second embodiment. In FIG. 4, the same symbols or reference numerals will be attached to the same elements as in the power supply circuit described in conjunction with the first embodiment, and a detailed description of repeated elements is omitted. As illustrated in FIG. 4, a power supply circuit 2 according to the second embodiment includes a current detection circuit 16 and a switch 17 in addition to the elements of the power supply circuit 1 according to the first embodiment.

The current detection circuit 16 detects an output current output from the switching element Q1, that is, the load current supplied to a load connected to the output terminal 22. The current detection circuit 16 includes, for example, a resistor which is provided in a path of the output current, and a comparison circuit which compares a voltage between both terminals of the resistor to a predetermined voltage. The predetermined voltage corresponds to a predetermined reference current. Thus, the current detection circuit 16 compares the output current to the reference current.

The switch 17 switches a back gate potential of the switching element Q1 between a first potential on the input terminal 21 side and a second potential on the output terminal 22 side, based on control of the control circuit 13. The first potential corresponds to a drain potential of the switching element Q1, and the second potential corresponds to a source potential of the switching element Q1.

The control circuit 13 operates the switching element Q1 and the switching element Q2 based on the comparison results of the input voltage (input terminal 21) and the predetermined reference voltage, in the same manner as described in the first embodiment. When the switching element Q1 is turned on, the control circuit 13 controls the switch 17 based on the output current which is detected by the current detection circuit 16. Hereinafter, a control operation of the switch 17 (as controlled by the control circuit 13) will be described in detail with reference to FIG. 5 and FIG. 6.

Figure 5:
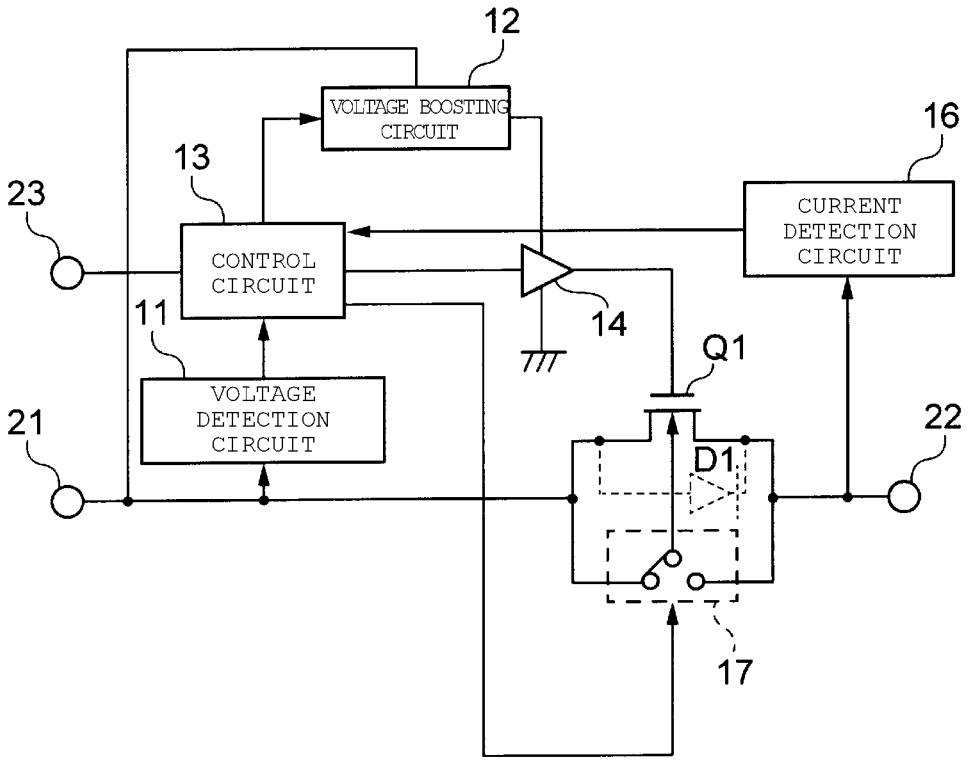
FIG. 5 is a diagram illustrating a state of a switch when an output current is greater than a reference current.
Figure 6:
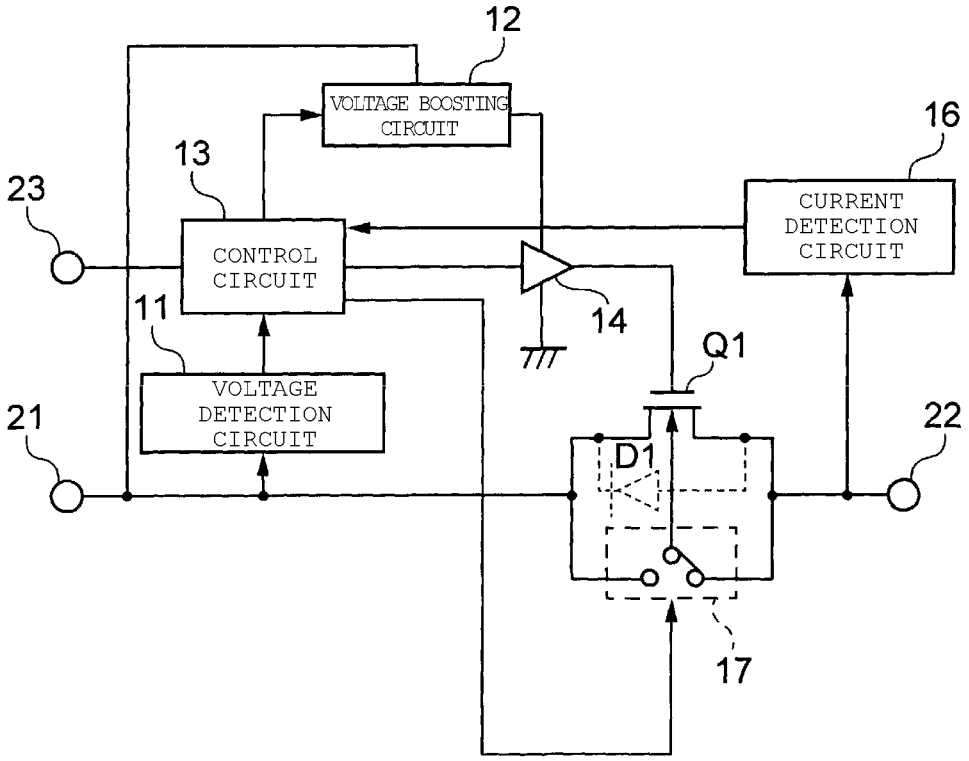
FIG. 6 is a diagram illustrating a state of the switch when the output current is less than or equal to the reference current.

FIG. 5 is a diagram illustrating a state of the switch 17 when the output current is smaller than the reference current. FIG. 6 is a diagram illustrating a state of the switch 17 when the output current is larger than the reference current. Note that FIG. 5 and FIG. 6 omit description of the switching element Q2 for the sake of clarity.

If the output current (as detected by the current detection circuit 16) is smaller than or equal to the predetermined reference current, as may be the case when a light (relatively small) load is connected to the output terminal 22, the control circuit 13 deactivates the voltage boosting circuit 12. Thereby, a boosted voltage is not input to the gate of the switching element Q1.

Furthermore, the control circuit 13 controls the switch 17 such that the back gate potential of the switching element Q1 becomes the first potential (drain potential), as illustrated in FIG. 5. Thereby, the back gate potential becomes equal to a drain potential. Thus, a current direction of a body diode D1 becomes a forward direction. Hence, a current flows through the body diode D1 of the switching element Q1 to be output at output terminal 22.

If the output current (as detected by the current detection circuit 16) is larger than the reference current as may be the case when a heavy (relatively large) load is connected to the output terminal 22, the control circuit 13 activates the voltage boosting circuit 12. Thereby, a voltage which is boosted by the voltage boosting circuit 12 is input to the gate of the switching element Q1.

Furthermore, the control circuit 13 controls the switch 17 such that the back gate potential of the switching element Q1 becomes the second potential (source potential), as illustrated in FIG. 6. Thereby, the back gate potential becomes equal to a source potential. Thus, the current direction of the body diode D1 is reversed. Hence, current flows only through a path (channel) between the drain and the source rather than through the body diode D1.

Figure 7:
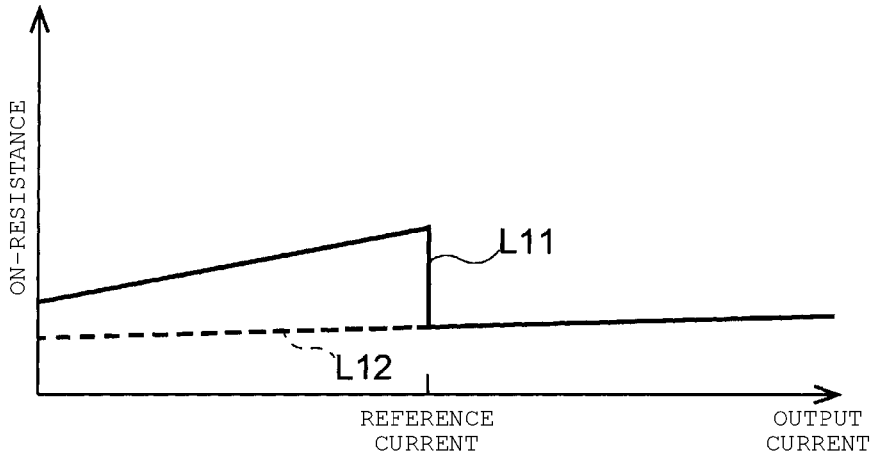
FIG. 7 is a graph illustrating a relationship between the output current and on-resistance of a switching element.
Figure 8:
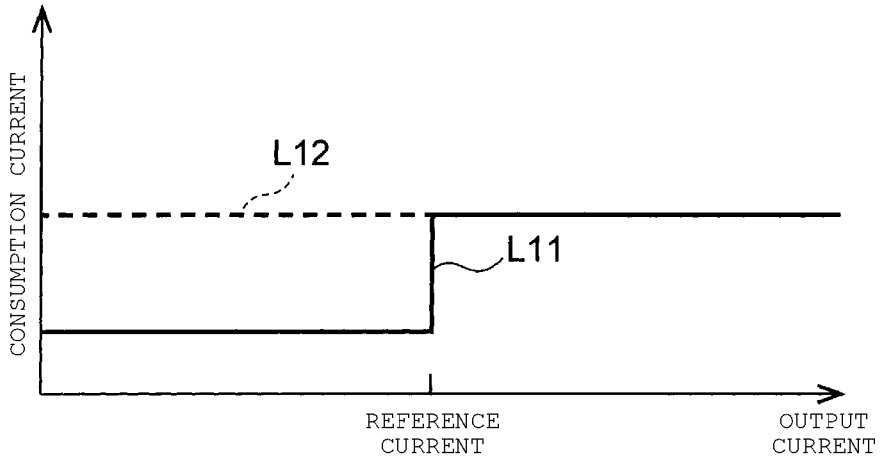
FIG. 8 is a graph illustrating a relationship between the output current and a consumption current of the power supply circuit.

FIG. 7 is a graph illustrating a relationship between the output current and the on-resistance of the switching element Q1. FIG. 8 is a graph illustrating a relationship between the output current and a consumption current of the power supply circuit. Furthermore, FIG. 9 is a graph illustrating a relationship between the output current and a ratio of the consumption current to the output current.

Figure 9:
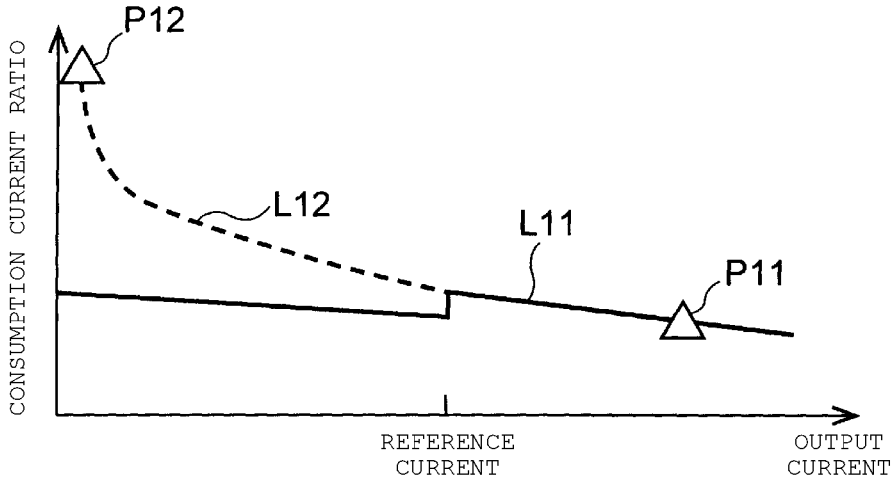
FIG. 9 is a graph illustrating a relationship between the output current and a ratio of the consumption current to the output current.

In FIG. 7, FIG. 8, and FIG. 9, a solid line L11 denotes characteristics when the back gate potential of the switching element Q1 is controlled as described above. A dashed line L12 denotes characteristics for a device in which the switch 17 has not been provided.

When the output current is larger than the reference current, the switching element Q1 is turned on by using the voltage boosting circuit 12, as described above. Accordingly, the on-resistance of the switching element Q1 can be maintained approximately constant, even when the output current increases, as illustrated in FIG. 7.

On the other hand, when the output current is smaller than or equal to the reference current, the operation of the voltage boosting circuit 12 stops, and the body diode D1 of the switching element Q1 becomes an available current path. Accordingly, as illustrated in FIG. 8, a consumption current can be reduced, as compared with a case where the switch 17 is not provided.

In addition, when the switch 17 is not provided, a ratio of the consumption current to the output current increases when the output current is smaller than the reference current, as illustrated in FIG. 9. However, if the body diode D1 of the switching element Q1 is used as described in the second embodiment, the ratio of the consumption current can be significantly decreased by deactivating the voltage boosting circuit 12. Thereby, it is possible to reduce a burden of an external power supply which supplies power to a load through the power supply circuit 2, and to efficiently supply the power of the external power supply to the load.

In the second embodiment, when the output current is larger than the reference current, the voltage boosting circuit 12 is activated and the switching element Q1 is turned on. However, a ratio of the consumption current to the output current decreases when the output current is larger than the reference current, as illustrated in FIG. 9. Accordingly, it is possible to reduce effects of the consumption current with respect to the aforementioned power supply, even if the consumption current is increased by the voltage boosting circuit 12.

According to the second embodiment described above, a stable operation can be ensured by driving the N-channel switching element Q1 using the voltage boosting circuit 12 when the input voltage is lower than the reference voltage, in the same manner as in the first embodiment. In addition, a consumption current can be reduced by driving the P-channel switching element Q2 when the input voltage is higher than the reference voltage.

Furthermore, in the second embodiment, the body diode D1 of the switching element Q1 serves as a current path when the output current is smaller than the reference current. In this case, the voltage boosting circuit 12 can be deactivated, and thus, the consumption current can be further reduced.

While certain embodiments have been described, these embodiments have been presented by way of example only, and are not intended to limit the scope of the disclosure. Indeed, the novel embodiments described herein may be embodied in a variety of other forms; furthermore, various omissions, substitutions and changes in the form of the embodiments described herein may be made without departing from the spirit of the present disclosure. The accompanying claims and their equivalents are intended to cover such forms or modifications as would fall within the scope and spirit of the present disclosure.

What is claimed is:

1. A power supply circuit, comprising:

a N-channel switching element that includes a drain connected to an input terminal and a source connected to an output terminal;

a P-channel switching element that includes a drain connected to the output terminal and a source connected to the input terminal;

a voltage detection circuit connected to the input terminal and configured to detect a level of an input voltage supplied at the input terminal;

a voltage boosting circuit configured to boost the input voltage and supply a boosted voltage to a gate of the N-channel switching element; and a control circuit configured to control the N-channel switching element, the P-channel switching element, and the voltage boosting circuit according to the level of the input voltage detected by the voltage detection circuit.

2. The power supply circuit according to claim 1, wherein, when the level of the input voltage detected by the voltage detection circuit is lower than or equal to a predetermined reference voltage, the control circuit activates the voltage boosting circuit, turns on the N-channel switching element, and turns off the P-channel switching element.

3. The power supply circuit according to claim 2, wherein, when the level of the input voltage detected by the voltage detection circuit is higher than the predetermined reference voltage, the control circuit deactivates the voltage boosting circuit, turns off the N-channel switching element, and turns on the P-channel switching element.

4. The power supply circuit according to claim 3, further comprising:

a current detection circuit connected to the output terminal and configured to detect an output current supplied through the N-channel switching element to the output terminal; and a switch configured to connect a back gate of the N-channel switching element to one of the drain of the N-channel switching element or the source of the N-channel switching element, wherein the control circuit is configured to control the switch based on a level of the output current detected by the current detection circuit.

5. The power supply circuit according to claim 4, wherein, when the level of the output current detected by the current detection circuit is less than or equal to a predetermined reference current, the control circuit deactivates the voltage boosting circuit, turns off the N-channel switching element, and controls the switch to connect the back gate of the N-channel switching element to the drain of the N-channel switching element.

6. The power supply circuit according to claim 5, wherein, when the level of the output current detected by the current detection circuit is greater than the predetermined reference current, the control circuit activates the voltage boosting circuit and controls the switch to connect the back gate of the N-channel switching element to the source of the N-channel switching element.

7. The power supply circuit according to claim 4, wherein, when the level of the output current detected by the current detection circuit is greater than the predetermined reference current, the control circuit activates the voltage boosting circuit and controls the switch to connect the back gate of the N-channel switching element to the source of the N-channel switching element.

8. The power supply circuit according to claim 1, further comprising:

a current detection circuit connected to the output terminal and configured to detect an output current supplied through the N-channel switching element to the output terminal; and a switch configured to connect a back gate of the N-channel switching element to one of the drain of the N-channel switching element or the source of the N-channel switching element, wherein the control circuit is configured to control the switch based on a level of the output current detected by the current detection circuit.

9. The power supply circuit according to claim 8, wherein, when the level of the output current detected by the current detection circuit is less than or equal to a predetermined reference current, the control circuit deactivates the voltage boosting circuit, turns off the N-channel switching element, and controls the switch to connect the back gate of the N-channel switching element to the drain of the N-channel switching element.

10. The power supply circuit according to claim 9, wherein, when the level of the output current detected by the current detection circuit is greater than the predetermined reference current, the control circuit activates the voltage boosting circuit and controls the switch to connect the back gate of the N-channel switching element to the source of the N-channel switching element.

11. The power supply circuit according to claim 8, wherein, when the level of the output current detected by the current detection circuit is greater than the predetermined reference current, the control circuit activates the voltage boosting circuit and controls the switch to connect the back gate of the N-channel switching element to the source of the N-channel switching element.

12. The power supply circuit according to claim 1, wherein the N-channel switching element comprises a N-channel metal-oxide-semiconductor field effect transistor, and the P-channel switching element comprises a P-channel metal-oxide-semiconductor field effect transistor.

13. The power supply circuit according to claim 1, further comprising:

an amplifier circuit powered by the boosted voltage from the voltage boosting circuit and configured to amplify a voltage signal output from the control circuit and supply the amplified voltage signal to a gate of the N-channel switching element.

14. A power supply circuit, comprising:

an input terminal connectable to a power supply;

an output terminal connectable to a load;

a N-channel switching element having a drain connected to the input terminal and a source connected to the output terminal;

a P-channel switching element having a drain connected to the output terminal and a source connected to the input terminal;

a voltage detection circuit connected to the input terminal and configured to compare a reference voltage level to a level of an input voltage supplied at the input terminal and output a signal corresponding to the comparison;

a voltage boosting circuit connected to the input terminal and configured to boost the input voltage to output a boosted voltage;

a control circuit configured to output a voltage signal for controlling the N-channel switching element and the P-channel switching element, and a control signal for controlling the voltage boosting circuit, the voltage signal and the control signal being output based on the signal from the voltage detection circuit; and a first amplification circuit powered by the boosted voltage and configured to amplify the voltage signal and output a first amplified voltage signal to a gate of the N-channel switching element.

15. The power supply circuit according to claim 14, further comprising:

a second amplification circuit configured to amplify the voltage signal and output a second amplified voltage signal to a gate of the P-channel switching element.

16. The power supply circuit according to claim 14, further comprising:

a current detection circuit connected to the output terminal and configured to detect an output current supplied to the output terminal; and a switch configured to connect a back gate of the N-channel switching element to one of the drain of the N-channel switching element or the source of the N-channel switching element, wherein the control circuit is configured to control the switch based on a level of the output current detected by the current detection circuit.

17. The power supply circuit according to claim 14, wherein, when the level of the input voltage is lower than or equal to the reference voltage level, the control circuit outputs the control signal to activate the voltage boosting circuit and the voltage signal to turn on the N-channel switching element, and turn off the P-channel switching element.

18. A power supply circuit, comprising:

an N-channel switching element that includes a drain connected to an input terminal and a source connected to an output terminal;

a P-channel switching element that includes a drain connected to the output terminal and a source connected to the input terminal;

a voltage detection circuit connected to the input terminal, the voltage detection circuit configured to compare a level of an input voltage supplied at the input terminal to a predetermined reference voltage level and to output a voltage detection signal according to the comparison;

a voltage boosting circuit configured to boost the input voltage and supply a boosted voltage to a gate of the N-channel switching element;

a current detection circuit connected to the output terminal, the current detection circuit configured to detect an output current supplied to the output terminal, compare the output current to a predetermined reference current and output a current detection signal according to the comparison;

a switch configured to connect a back gate of the N-channel switching element to one of the drain of the N-channel switching element or the source of the N-channel switching element; and a control circuit configured to receive the voltage detection signal and the current detection signal and control the N-channel switching element, the P-channel switching element, the voltage boosting circuit, and the switch based on the voltage detection signal and the current detection signal.

19. The power supply circuit according to claim 18, wherein, when the voltage detection signal indicates the level of the input voltage is lower than or equal to the predetermined reference voltage, the control circuit activates the voltage boosting circuit, turns on the N-channel switching element, and turns off the P-channel switching element.

20. The power supply circuit according to claim 19, wherein, when the current detection signal indicates the level of the output current is less than or equal to the predetermined reference current, the control circuit deactivates the voltage boosting circuit, turns off the N-channel switching element, and controls the switch to connect the back gate of the N-channel switching element to the drain of the N-channel switching element.

* * * * *